United States Patent [19]

Sarian et al.

[11] 4,388,505

[45] Jun. 14, 1983

[54] ADJUSTABLE PRESSURE-ACTUATED SWITCH

[75] Inventors: Grigor Sarian, Los Angeles; Dee J. Neville, Simi Valley, both of Calif.

[73] Assignee: Puritan-Bennett Corp., Kansas City, Mo.

[21] Appl. No.: 232,839

[22] Filed: Feb. 9, 1981

[51] Int. Cl.[3] ..... H01H 35/32

[52] U.S. Cl. ..... 200/83 C; 200/83 N; 200/83 S; 200/153 L

[58] Field of Search ..... 200/83 R, 83 C, 83 N, 200/83 S, 83 SA, 83 WM, 153 L, 153 LA, 153 LB

[56] References Cited

U.S. PATENT DOCUMENTS

| | | | |
|---|---|---|---|
| 2,471,838 | 5/1944 | Ross | 200/83 C |
| 3,319,023 | 5/1967 | Lake | 200/83 WM |
| 3,922,515 | 11/1975 | Meisenheimer, Jr. | 200/83 S |
| 4,220,836 | 9/1980 | Hersey | 200/83 S |
| 4,272,959 | 6/1981 | Yamane | 200/83 C |

*Primary Examiner*—G. P. Tolin

*Attorney, Agent, or Firm*—Filwider, Patton, Rieber, Lee & Utecht

[57] ABSTRACT

A pressure switch having a movable bellows (14) in a pressure chamber (12), a first electrical contact (16) movable with the bellows, a three-dimensional cam (18) and a second electrical contact (20) resiliently biased to follow the cam. In the preferred embodiment of the invention, the cam has a radius that linearly increases with the angular position of the cam, and is tapered toward one end for all regions about its periphery except at a point of maximum radius. Calibration at low pressure is effected by rotating the cam to its maximum-radius point, applying a standard low pressure to the chamber (12) and rotating the chamber about a threaded coupling (26) until the contacts (16) and (20) are at the point of closing. Calibration at high pressure is effected by rotating the cam to its minimum-radius point, applying a standard high pressure to the chamber, and adjusting the axial position of the cam until the contacts are at the point of closing. After such calibration, no recalibration is needed for intermediate pressure settings of the cam.

17 Claims, 5 Drawing Figures

ADJUSTABLE PRESSURE-ACTUATED SWITCH

BACKGROUND OF THE INVENTION

This invention relates generally to pressure-actuated switches, and, more particularly, to pressure-actuated switches of the adjustable type, i.e., adjustable to complete an electrical circuit in response to a selected threshold pressure. Such switches have a wide variety of applications, and are particularly useful in the field of respirators, the operation of which depends on the accurate and repeatable sensing of pressure.

Although there are many pressure-actuated switches of the adjustable type, most of them have no convenient means for calibration. Furthermore, even switches having a calibration means are typically so unreliable as to necessitate recalibration each time an adjustment is made to the threshold pressure setting. It will be appreciated, therefore, that there has long been a need for a pressure-actuated switch of the adjustable type which can be conveniently calibrated, and which requires no recalibration after each adjustment. The present application is directed to this end.

SUMMARY OF THE INVENTION

The present invention resides in an adjustable, pressure-actuated switch and method for its use, the switch having two independent calibration means, for calibrating the switch at two different pressures, whereby the switch can then be adjusted for operation at a selected pressure between the two calibration pressures. Briefly, and in general terms, the pressure-actuated switch of the invention comprises a pressure chamber, diaphragm means disposed in the chamber and having one side exposed to the pressure therein, a first electrical contact supported on the diaphragm means and movable with it along a straight-line path as the pressure in the chamber varies, a second electrical contact movable with respect to the first for purposes of adjustment and calibration of the switch, and pressure selection means for adjusting the relative positions of the contacts, to provide for their closure at a selected pressure setting.

More importantly, the switch includes first and second calibration means operable independently of each other to provide relative movement between the two electrical contacts when the pressure selection means is adjusted to first and second pressure settings, respectively, and the pressure chamber is exposed to corresponding first and second calibration pressures. After calibration, the pressure selection means may be adjusted to select any intermediate operating pressure for the switch.

More specifically, in a presently preferred embodiment of the invention the pressure selection means includes a three-dimensional cam rotatable about an axis perpendicular to the path of the first electrical contact and also movable axially. When the cam is angularly positioned at a low pressure setting, its effective radius is at a maximum and is constant along the cam length. As the cam is rotated toward a high pressure setting, its effective radius becomes linearly smaller. Moreover, the cam is tapered in such a manner that the effective radius at any angular position decreases towards one end, except at the aforementioned low-pressure setting.

The first calibration means in this preferred embodiment includes means for adjusting the position of the pressure chamber, and with it, the diaphragm means and first electrical contact, with respect to the position of the cam. The second calibration means includes means for adjusting the position of the cam along its axis when in the high-pressure setting, and thereby moving the second electrical contact with respect to the first.

Since the second calibration means is independent of the first calibration means, the switch can be conveniently calibrated at two selected pressures, and since the cam radius changes linearly as the cam is rotated, the switch remains effectively calibrated over its entire range.

In the presently preferred embodiment of the invention, the first calibration means includes a threaded coupling permitting movement of the pressure chamber with respect to the cam, and the second calibration means includes an asymmetrical cam shaft forming a tight but slideable fit with the cam, and thereby adjustably securing the cam in a selected position along its axis.

In an alternative embodiment of the invention, instead of a three-dimensional cam there is a helical camming surface, which can be rotated by a pressure-setting knob. The second electrical contact rides on the helical camming surface. When the camming surface presents its lowest point to the second electrical contact, the switch can be adjusted to a high-pressure setting, by rotating the presure chamber on its threaded coupling. The low-pressure setting is effected by an adjusting screw which varies the highest point of the helical cam. Thus, movement of the adjusting screw varies the slope of the camming surface, in much the same manner that the slope of the three-dimensional cam is varied by changing its axial position.

It will be appreciated from the foregoing that the present invention represents a significant advance in adjustable pressure-actuated switches. In particular, it allows for independent calibration at two widely spaced pressure settings, to provide for accurate and repeatable operation over a wide pressure range. Other aspects and advantages of the invention will become apparent from the following more detailed description, taken in conjunction with the accompanying drawings.

DETAILED DESCRIPTION

Figure 1:
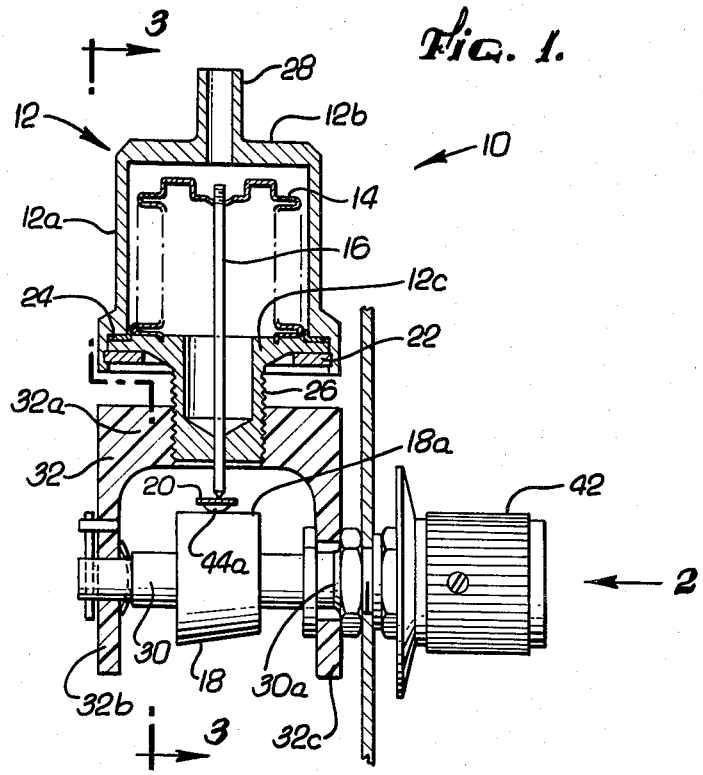
FIG. 1 is a sectional view of a pressure-actuated switch embodying the present invention.
Figure 2:
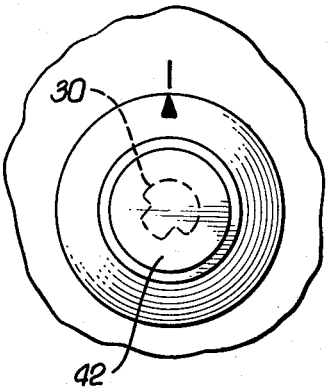
FIG. 2 is an enlarged front-elevational view of the adjustment knob of the switch, taken in the direction of the arrow 2 in FIG. 1.

As shown in the drawings for purposes of illustration, the present invention is concerned with an adjustable, pressure-actuated switch, indicated generally by reference numeral 10. The switch 10 includes a pressure chamber 12, housing a bellows 14, and a vertically oriented rod 16 affixed to the bellows and forming one electrical contact, a cam 18 mounted on a horizontal axis, and a second electrical contact 20 riding on the cam. When pressure is applied to the chamber 12, the bellows 14 contracts and moves the rod 16 in a vertical direction towards the second electrical contact 20. When the switch 10 is properly calibrated and adjusted, the electrical contacts 16 and 20 close when a selected threshold pressure level is reached. Although this basic principle is well known in the art, switches of the same general type are notoriously difficult to maintain in accurate calibration, and some have no calibration means at all.

In accordance with the invention, the cam 18 is contoured both in a circumferential sense and in an axial sense, to allow independent calibration at two widely spaced pressure levels, representing the extremes of a pressure range over which the switch is to be operated. Since the switch behaves in a practically linear manner over the range, no further calibration is needed after calibration at the extremes of the range.

More specifically, the pressure chamber 12 includes a cylindrical wall 12*a*, an integral top wall 12*b* and a circular base 12*c* assembled in sealed contact with the cylindrical wall by means of a retaining ring 22 and sealing ring 24. The base 12*c* has an integral threaded nipple 26 projecting symmetrically from it, and the top 12*b* has a smaller nipple 28 for attachment to a pressure hose (not shown).

The rod 16 is rigidly attached to the bellows 14, as by soldering, and extends axially down through the bellows and out through the threaded nipple 26. The cam 18 is supported on a horizontal shaft 30 which is, in turn, journaled in a cam housing 32. The cam housing 32 is basically an integral, open box, having a top 32*a* with a threaded hole engaging the threaded nipple 26, two sidewalls 32*b* and 32*c*, in which the shaft 30 is journaled, and a third sidewall 32*d* by means of which the entire switch assembly may be supported on a housing, a portion of which is shown at 40. The shaft 30 on which the cam 18 is mounted extends through the sidewall 32*c* and has a control knob 42 attached at its end.

The second electrical contact 20 is supported on a resilient L-shaped bracket 44, one arm of which is secured to the sidewall 32*d*. The bracket 44 has a convex cam follower portion 44*a* near its free end, and it is this portion that rides on the surface of the cam 18.

Figure 3:
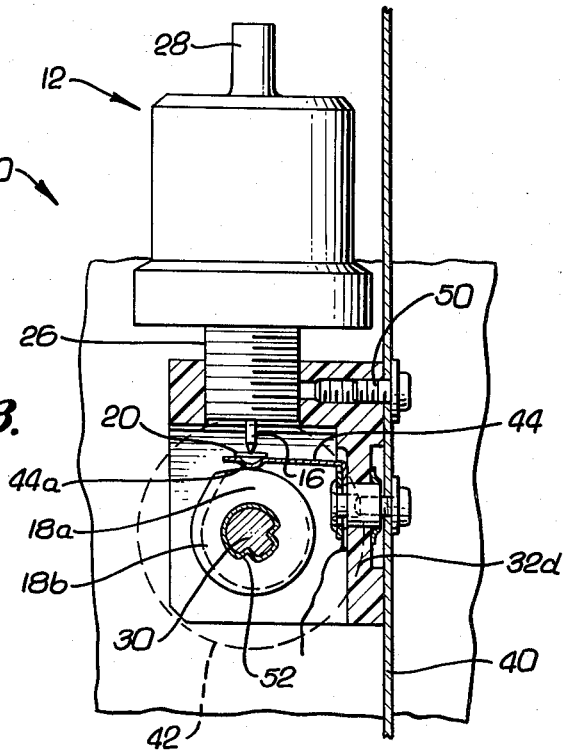
FIG. 3 is a sectional view drawn to the same scale as FIG. 1, and taken substantially along the line 3—3 in FIG. 1.

The cam 18 is shown in FIG. 3 positioned with its maximum effective radius, indicated at 18*a*, presented to the cam follower 44*a*. As the cam 18 turns counter-clockwise (as viewed in FIG. 3), its radius gradually decreases and the contact 20 is lowered, until a point of minimum radius is reached, as indicated at 18*b*. As shown in FIG. 1, the maximum radius at 18*a* is maintained uniformly along the length of the cam 18. However, once the maximum-radius position is departed from, there is a taper on the cam 18 from one end to the other. As will shortly be explained, it is this taper which permits independent calibration at a high pressure.

To calibrate the switch at a low pressure, the knob 42 is first turned to its lowest pressure setting, corresponding to the maximum-radius setting position 18*a* of the cam 18, and a known low pressure, which may be at or below atmospheric pressure, is applied to the nipple 28. Then the rod 16 is adjusted until it just makes contact with the second electrical contact 20. This latter adjustment is made by rotating the entire pressure chamber 12 with respect to the cam housing 32, then locking the two together by means of a set screw 50 extending radially through the cam housing 32 and bearing on the nipple 26. This calibration setting will be unaffected by the axial position of the cam 18, since the maximum radius of the cam is the same all along the cam length.

To calibrate the switch at a high pressure, a known high pressure is applied to the nipple 28 and the control knob 42 is turned to its high-pressure position, corresponding to the minimum-radius position 18*b* of the cam. Then the axial position of the cam is adjusted until the rod 16 and contact 20 are just at the point of making contact. This can be done by means of a set screw (not shown) securing the cam 18 to the shaft 30, or by merely sliding the cam along the shaft 30, which, as shown, is asymmetrical in cross section and is sized for a tight but slideable fit in a correspondingly shaped clip 52 in the bore of the cam.

Once the switch has been calibrated at two pressures, calibration for any intermediate pressure setting is unnecessary, since the cam radius increases linearly between the two extreme settings.

Figure 4:
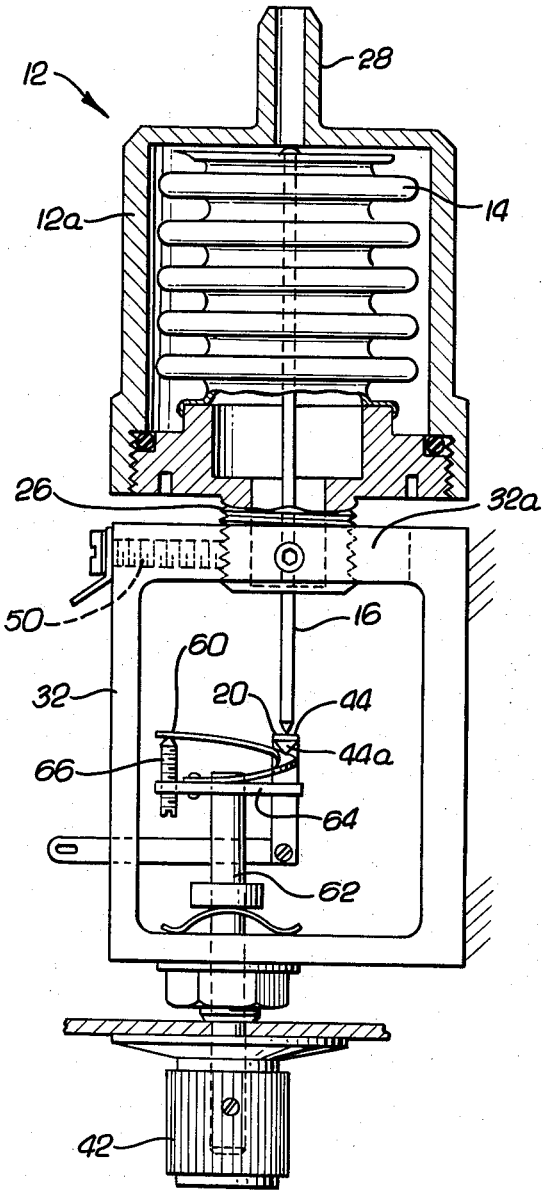
FIG. 4 is a sectional view of an alternative embodiment of the invention.
Figure 5:
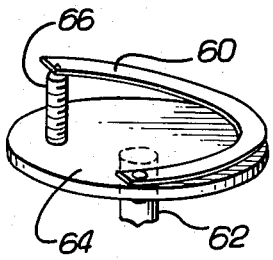
FIG. 5 is a simplified perspective view of the helical cam used in the embodiment shown in FIG. 4.

As shown in FIGS. 4 and 5, the device of the invention may alternatively use a helical cam 60 instead of the three-dimensional cam 18 of FIG. 1. In this embodiment, the control knob is mounted on a vertical shaft 62 parallel with the rod 16. The shaft 62 has a disk 64 affixed to its upper end, and the helical cam 60 is affixed by one end to the upper face of this disk. The cam follower 44*a* is so positioned as to ride on the upper surface of the helical cam 60. An adjusting screw 66 extends through a hole in the periphery of the disk 64 and contacts the cam 60 near its free upper end. It will be seen that adjustment of the screw 66 varies the slope of the camming surface.

As in the first-described embodiment, a first calibration step is effected by applying a standard pressure to the nipple 28, rotating the shaft 62 until the lowest point on the camming surface is reached, then rotating the pressure chamber 12 until the rod 16 just makes contact with the second electrical contact 20. However, in this embodiment it is the high-pressure calibration that is effected by rotating the pressure chamber 12. When the shaft 62 is rotated clockwise to its high-pressure setting, the cam 60 presents its lowest point to the cam follower. Low-pressure calibration is effected by rotating the shaft 62 counter-clockwise to a desired low-pressure setting, applying a known low pressure to the nipple 28, and then adjusting the screw 66 until the switch contacts are at the point of closing. As in the first described embodiment, the two calibration steps are independent of each other and no recalibration is needed for intermediate pressure settings.

It will be appreciated from the foregoing that the pressure switch of the present invention is easy to calibrate initially and requires no recalibration when its pressure setting is adjusted. It therefore provides highly accurate and repeatable results over a relatively wide pressure range. It will also be appreciated that, although a specific embodiment of the invention has been described in detail for purposes of illustration, various modifications may be made without departing from the spirit and scope of the invention. Accordingly, the invention is not to be limited except as by the appended claims.

We claim:

1. An adjustable pressure-actuated switch, comprising:

a pressure chamber connected to a source of pressure to be use in actuating said switch;

diaphragm means disposed in said pressure chamber and exposed on one side to the pressure in said chamber;

a first electrical contact affixed to said diaphragm means and movable therewith along a path;

a second electrical contact disposed in the path of movement of said first electrical contact;

pressure selection means for adjusting the relative spacing between said first and second electrical contacts, to allow for their closure at a selected pressure;

first calibration means, for adjusting the relative spacing between said first and second electrical contacts when said pressure selection means is set at a first pressure setting and a first reference pressure is applied to said pressure chamber; and second calibration means, operable independently of said first calibration means, for adjusting the relative spacing between said first and second electrical contacts when said pressure selection means is set at a second pressure setting and a second reference pressure is applied to said pressure chamber;

whereby calibration of said switch is maintained for all intermediate settings of said pressure selection means between said first and second pressure settings.

2. An adjustable pressure actuated switch as set forth in claim 1, wherein:

said pressure selection means includes a cam housing and a cam of variable radius mounted in said housing for rotation about an axis approximately perpendicular to the path of said first electrical contact; and said second electrical contact is resiliently biased to follow the periphery of said cam and thereby move toward or away from said first electrical contact, depending on the direction of rotation of said cam.

3. An adjustable pressure-actuated switch as set forth in claim 2, wherein:

said first calibration means is operative to adjust the spacing between said first and second electrical contacts when said cam is positioned at a low-pressure setting corresponding to a point of maximum cam radius, and the first reference pressure is a selected low pressure applied to said pressure chamber.

4. An adjustable pressure-actuated switch as set forth in claim 3, wherein:

said cam is tapered in an axial direction except at its point of maximum radius; and said second calibration means includes means for moving said cam axially, when said cam is not positioned at a low-pressure setting and the second reference pressure is a selected high pressure applied to said pressure chamber.

5. An adjustable pressure-actuated switch as set forth in claim 4, wherein:

said first calibration means includes a threaded coupling between said pressure chamber and said cam housing, whereby rotation of said chamber moves said diaphragm means and said first electrical contact with respect to said cam and said second electrical contact.

6. An adjustable pressure-actuated switch as set forth in claim 1 or 2, wherein:

said diaphragm means includes a bellows having a top wall and expandable sidewalls; and said first electrical contact is a rod affixed to said top wall of said bellows and extending through said bellows, the pressure in said pressure chamber being applied to the upper surface of said top wall, to contract said sidewalls and move said rod in a downward direction.

7. An adjustable pressure-actuated switch as set forth in claim 1, wherein said pressure selection means includes a cam housing and a helical cam mounted in said housing for rotation about an axis parallel to the path of said first electrical contact; and said second electrical contact is resiliently biased to follow said helical cam and thereby move toward or away from said first electrical contact, depending on the direction of rotation of said cam.

8. An adjustable pressure-actuated switch as set forth in claim 7, wherein:

said first calibration means is operative to adjust the spacing between said first and second contacts when said cam is positioned at a high-pressure setting corresponding to a point of minimum cam height, and the first reference pressure is a selected high pressure applied to said pressure chamber.

9. An adjustable pressure-actuated switch as set forth in claim 8, wherein:

said second calibration means includes means for independently adjusting the cam slope when said cam is at a low-pressure setting and the second reference pressure is a selected low pressure applied to said pressure chamber.

10. An adjustable pressure-actuated switch as set forth in claim 9, wherein:

said first calibration means includes a threaded coupling between said pressure chamber and said cam housing, whereby rotation of said chamber moves said diaphragm means and said first electrical contact with respect to said cam and said second electrical contact.

11. An adjustable pressure-actuated switch as set forth in claim 7, wherein:

said diaphragm means includes a bellows having a top wall and expandable sidewalls; and said first electrical contact is a rod affixed to said top wall of said bellows and extending through said bellows, the pressure in said pressure chamber being applied to the upper surface of said top wall, to contract said sidewalls and move said rod in a downward direction.

12. An adjustable pressure-actuated switch comprising:

a pressure chamber connectable to a source of pressure to be used in actuating said switch;

a bellow disposed in said pressure chamber and exposed on the outside to the pressure in said chamber;

a first electrical contact affixed to and movable with said bellows along a straight-line path as the pressure varies;

a cam housing rigidly connected to said pressure chamber;

a three-dimensional cam journaled in said cam housing and rotatable between low-pressure and high-pressure settings about an axis approximately perpendicular to the path of said first electrical contact, and also axially movable along its axis of rotation, said cam being contoured circumferentially from a point of minimum radius to a point of maximum radius, and being tapered toward one end except at its point of maximum radius, which is uniform along the length of said cam;

a second electrical contact riding on said cam and disposed in the path of said first electrical contact;

means for adjusting the position of said first electrical contact with respect to that of said second electrical contact, with said cam at a low-pressure setting, to provide a low-pressure calibration point;

means for axially moving said cam when at a high-pressure setting along its axis of rotation and thereby moving said second electrical contact with respect to said first electrical contact, and providing a high-pressure calibration point;

whereby said cam is rotatable to select an intermediate pressure setting without recalibration.

13. An adjustable pressure-actuated switch as set forth in claim 12, wherein:

said means for adjusting the position of said first electrical contact includes a threaded coupling between said cam housing and said pressure chamber, wherein relative rotation of said cam housing and said pressure chamber moves said bellows and said first electrical contact with respect to said second electrical contact.

14. An adjustable pressure-actuated switch as set forth in claim 12 or 13, wherein:

said means for moving said cam along its axis of rotation includes means for securing said cam tightly but slideably on its axis of rotation.

15. An adjustable pressure-actuated switch comprising:

a pressure chamber connectable to a source of pressure to be used in actuating said switch;

a bellows disposed in said pressure chamber and exposed on the outside to the pressure in said chamber;

a first electrical contact affixed to and movable with said bellows along a straight-line path as the pressure varies;

a cam housing rigidly connected to said pressure chamber;

a helical cam rotatable between low-pressure and high-pressure settings about an axis approximately parallel to the path of said first electrical contact;

a second electrical contact riding on said cam and disposed in the path of said first electrical contact;

means for adjusting the position of said first electrical contact with respect to that of said second electrical contact, with said cam at a high-pressure setting, to provide a high-pressure calibration point; and means for adjusting the maximum height of said cam when at the low-pressure setting, thereby moving said second electrical contact with respect to said first electrical contact, and providing a low-pressure calibration point independent of the high-pressure calibration point;

whereby said cam is rotatable to select an intermediate pressure setting without recalibration.

16. An adjustable pressure-actuated switch as set forth in claim 15 wherein:

said means for adjusting the position of said first electrical contact includes a threaded coupling between said cam housing and said pressure chamber, wherein relative rotation of said cam housing and said pressure chamber moves said bellows and said first electrical contact with respect to said second electrical contact.

17. An adjustable pressure-actuated switch as set forth in claim 15 or 16, wherein:

said means for adjusting the maximum height of said cam includes an adjusting screw against which said cam is resiliently self-biased.

* * * * *

UNITED STATES PATENT AND TRADEMARK OFFICE

CERTIFICATE OF CORRECTION

PATENT NO. : 4,388,505

DATED : June 14, 1983

INVENTOR(S) : Sarian et al.

It is certified that error appears in the above—identified patent and that said Letters Patent is hereby corrected as shown below:

Claim 11, line 45, delete "contract" and insert therefor -- contact --.

Signed and Sealed this

Fourth Day of October 1983

[SEAL]

*Attest:*

GERALD J. MOSSINGHOFF

*Attesting Officer*

*Commissioner of Patents and Trademarks*